US007283023B2

(12) United States Patent
Robert

(10) Patent No.: US 7,283,023 B2
(45) Date of Patent: Oct. 16, 2007

(54) ELECTROSTATIC MICRO-SWITCH FOR COMPONENTS WITH LOW OPERATING VOLTAGES

(75) Inventor: Philippe Robert, Grenoble (FR)

(73) Assignee: Commissariat a l'Energie Atomique, Paris (FR)

( * ) Notice: Subject to any disclaimer, the term of this patent is extended or adjusted under 35 U.S.C. 154(b) by 337 days.

(21) Appl. No.: 10/536,632

(22) PCT Filed: Nov. 27, 2003

(86) PCT No.: PCT/FR03/50138

§ 371 (c)(1),
(2), (4) Date: May 26, 2005

(87) PCT Pub. No.: WO2004/051688

PCT Pub. Date: Jun. 17, 2004

(65) Prior Publication Data

US 2006/0164193 A1 Jul. 27, 2006

(30) Foreign Application Priority Data

Nov. 28, 2002 (FR) ..... 02 14944

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 6,115,231 A * 9/2000 Shirakawa ..... 361/233

(Continued)

FOREIGN PATENT DOCUMENTS

EP 1 156 504 A2 11/2001

(Continued)

OTHER PUBLICATIONS

Ponchak et al., "Finite Ground Coplanar Waveguide Shunt MEMS Switches for Switched Line Phase Shifters", 30th European Microwave Conference Proceedings, Oct. 3-5, 2000, Proceedings of the European Microwave Conference, London: CMP, GB, vol. 1 of 3 Conf. 30, pp. 252-255, XP001060741.

(Continued)

*Primary Examiner*—Elvin Enad
*Assistant Examiner*—Bernard Rojas
(74) *Attorney, Agent, or Firm*—Thelen Reid Brown Raysman & Steiner LLP

(57) ABSTRACT

The invention relates to an electrostatic micro-switch intended to connect two conductor paths (4, 5) placed on a support, the connection between the two conductor paths being created by means of a contact stud (6) fitted to the distortion means (3) made in insulating material and capable of distorting in relation to the support, under the influence of an electrostatic force generated by control electrodes, the contact stud connecting the ends (14, 15) of the two conductor paths (4, 5) when the distortion means are sufficiently distorted. The control electrodes are laid out on the distortion means and the support in two sets of electrodes, a first set of electrodes (101, 102, 33, 53) intended to generate a first electrostatic force to initiate the distorting of the distortion means, a second set of electrodes (101, 102, 7, 8) intended to generate a second electrostatic force to continue the distorting of the distortion means (3) so that the contact stud (6) connects the ends (14, 15) of the two conductor paths.

6 Claims, 3 Drawing Sheets

U.S. PATENT DOCUMENTS

| | | | | |
|---|---|---|---|---|
| 6,608,268 | B1 * | 8/2003 | Goldsmith | 200/181 |
| 6,720,851 | B2 * | 4/2004 | Hallbjorner et al. | 335/78 |
| 7,053,736 | B2 * | 5/2006 | Nelson | 335/70 |
| 2002/0027487 | A1 | 3/2002 | Suzuki | |

FOREIGN PATENT DOCUMENTS

| | | | |
|---|---|---|---|
| EP | 1 156 504 | A3 | 11/2001 |
| WO | WO-94/27308 | A1 | 11/1994 |

OTHER PUBLICATIONS

Yao et al., "A Surface Micromachined Miniature Switch for Telecommunications Applications with Signal Frequesncies from DC up to 4 GHz", International Conference on Solid State Sensors and Actuators and Eurosensors, vol. 2 Jun. 25, 1995, pp. 384-387, XP000646268.

Yao, "RF MEMS from a device perspective", Journal of Micromechanics and Microengineering, Dec. 2000, pp. R9-R38, XP002254912, ISSN: 0960-1317.

* cited by examiner

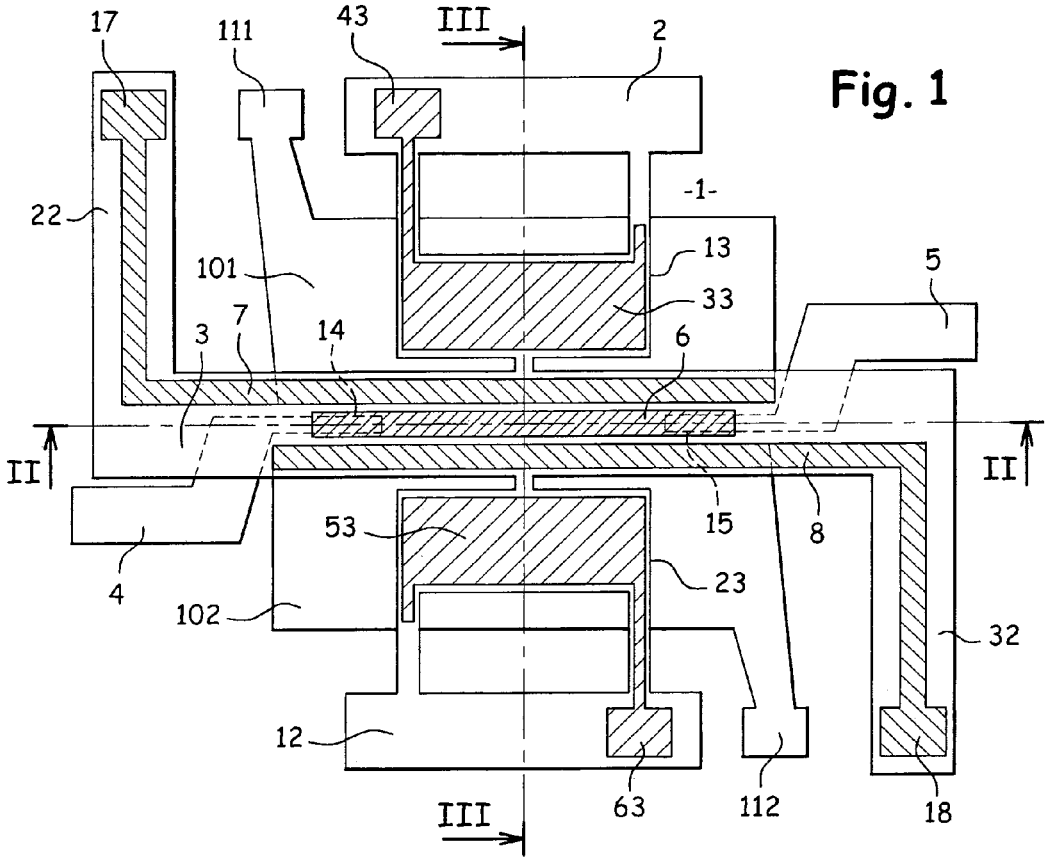
Fig. 1
Fig. 2
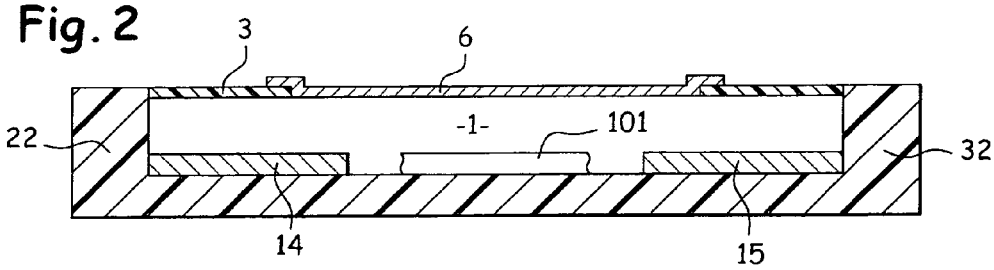
Fig. 3
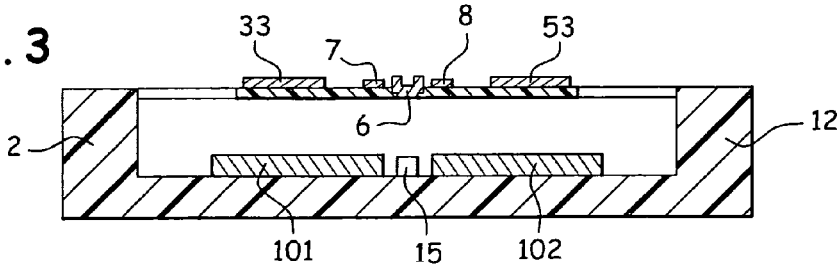

ELECTROSTATIC MICRO-SWITCH FOR COMPONENTS WITH LOW OPERATING VOLTAGES

CROSS-REFERENCE TO RELATED APPLICATION

This application claims priority based on International Patent Application No. PCT/FR2003/050138, entitled "Electrostatic Microswitch for Low-Voltage-Actuation Components" by Philippe Robert, which claims priority of French Application No. 02 14944, filed on Nov. 28, 2002, and which was not published in English.

TECHNICAL FIELD

The invention relates to an electrostatic micro-switch with high operating reliability and suitable for components with low operating voltages. The expression micro-switch incorporates micro-relays, MEMS (Micro-Electro-Mechanical-System) type actuators and high frequency actuators.

STATE OF THE PRIOR ART

The article entitled "RF MEMS from a device perspective" by J. Jason Yao, published in J. Micromech. Microeng. 10(2000), pages R9 to R38, summarises the progress made in the field of MEMS for high frequency applications.

The following specifications are applied to high frequency components or RF components for mobile phones:

- supply voltage less than 5 V;
- insulation greater than 30 dB;
- insertion loss less than 0.3 dB;
- reliability for a number of cycles greater than $10^9$;
- dimensions less than 0.05 $mm^2$.

Micro-switches are widely used in the communications field: in the routing of signals, the impedance tuning networks, the adjusting of gain from amplifiers, etc. as regards the frequency bands of signals to be switched over, these frequencies lie between a few MHz and several tens of GHz.

Traditionally, for these RF circuits, we use switches derived from microelectronics, which allow integration with circuit electronics and which have low manufacturing costs. As regards performance, these components are however rather limited. Thus, Fet type switches made in silicon can transmit high power signals at low frequency but not at high frequency. The MESFET type switches made in GaAs or the PIN diodes operating at high frequency but only for low level signals. Finally, in a general manner, above 1 GHz, all these electronic micro-switches have a considerable insertion loss (traditionally about 1 to 2 dB) in the on state and a rather low insulation in the open state (−20 to −25 dB). The replacement of conventional components with MEMS micro-switches is consequently promising for this type of application.

Through their design and principle of operating, the MEMS switches have the following characteristics:

- low insertion loss (traditionally less than 0.3 dB);
- considerable insulation of the MHz in millimetric measurement (traditionally greater than −30 dB);
- low consumption;
- absence of response non-linearity.

We can distinguish two types of contact for MEMS micro-switches.

One of these types of contact is the ohmic contact switch disclosed in the article entitled "RF MEMS from a device perceptive" by the aforementioned J. Jason Yao and in the article entitled "A Surface Micromachined Miniature Switch for Telecommunications Applications with Signal frequencies from DC up to 4 GHz" by J. Jason Yao and M. Frank Chang, published in the Transducer's 95, Eurosensors IX magazine pages 384 to 387. In this type of contact, the two RF paths are brought together using a short circuit (metal to metal contact). This type of contact is suitable for both continuous signals and high frequency signals (greater than 10 GHz).

The other type of contact disclosed in the article entitled "RF MEMS from a device perceptive" by the aforementioned J. Jason Yao and in the article entitled "Finite Ground Coplanar Waveguide Shunt MEMS Switches for Switched Line Phase Shifters" by George E. Ponchak et al., published in the $30^{th}$ European Microwave Conference, Paris 2000, pages 252 to 254. In this type of contact, a cushion of air is added electro-mechanically to obtain a variation in capacity between the closed state and the open state. This type of contact is especially suited to high frequencies (greater than 10 GHz) but inadequate at low frequencies.

In the state of the art, we can distinguish two large principles of operating for MEMS switches: the heat operating switches and the electrostatic operating switches.

The heat operating switches have the advantage of low operating voltage. However, they have the following inconveniences: excessive consumption (especially in mobile phone applications), low commutation speed (due to the heat inertia) and often costly and complex technology.

The electrostatic operating switches have the advantages of fast commutation speed and generally straightforward technology. However, they have the inconvenience of poor reliability. This is a key point for electrostatic micro-switches with low operation voltages (possibility of bonding the structures). Indeed, due to the configuration of electrostatic operating micro-switches of the state of the art, the size of this type of component in order to have a low operating voltage (less than 10 V, even less than 5 V) necessarily implies:

- either a reduction in the mechanical stiffness of the component in which case we notice that the switch is highly sensitive to accelerations and shocks, which is a problem for mobile phones;
- either an increase in the surface of the operating electrodes, which thus forcibly induces an increase in the damping and therefore an increase in the commutation time;
- either a compromise between these two parameters.

Finally, irrespective of the chosen option, there is a significant reduction in the reliability of the micro-switch due to the elevated risk of structure bonding.

SUMMARY OF THE INVENTION

To overcome these inconveniences of the prior art, the invention proposes a micro-switch which distinguishes itself from the state of the art through its operation mode and its design. Indeed, it has two distinct sets of operating electrodes and uses a two-step operating mode which allows it to reconcile a low operating voltage and a short commutation time whilst preserving a mechanical stiffness of the micro-switch under intensive operating.

Therefore the purpose of the invention is an electrostatic micro-switch intended to electrically connect at least two electrically conductive paths placed on a support, the electric connection between the two conductor paths being created by means of a contact stud fitted to the distortion means made in insulating material and capable of distorting in relation to the support under the influence of an electrostatic force generated by the control electrodes, the contact stud creating the electric connection of the ends of the two conductor paths when the distortion means are sufficiently distorted, characterised in that the control electrodes are laid out on the distortion means and the support in two sets of electrodes, a first set of electrodes intended to generate a first electrostatic force to initiate the distorting of the distortion means, a second set of electrodes intended to generate a second electrostatic force to continue the distorting of the distortion means so that the contact stud electrically connects the ends of the two conductor paths.

The control electrodes laid out on the distortion means can be placed on the latter so that the distortion means are interposed between them and the control electrodes laid out on the support.

According to an alternative embodiment, the control electrodes laid out on the support comprise two electrodes each of which is a common electrode to the first set of electrodes and to the second set of electrodes.

The distortion means can comprise a beam embedded at its two ends or a cantilever beam. In this case, the control electrodes laid out on the distortion means can comprise the electrodes of one of the two sets of electrodes placed on the annex parts attached to the beam and fitted on each side of the beam. Also in this case, the control electrodes laid out on the distortion means can comprise the electrodes of the other of the two sets of electrodes placed on the beam and fitted on each side of the contact stud.

BRIEF DESCRIPTION OF THE DRAWINGS

The invention will be better understood and other advantages and features will become clearer upon reading the description that follows, given by way of a non-restrictive example, accompanied with annexed drawings among which:

FIG. 1 is a top view of an electrostatic micro-switch according to the invention;

FIG. 2 is a cross section along the axis II-II in FIG. 1;

FIG. 3 is a cross section along the axis III-III in FIG. 1;

DETAILED DESCRIPTION OF EMBODIMENTS OF THE INVENTION

Figure 4:
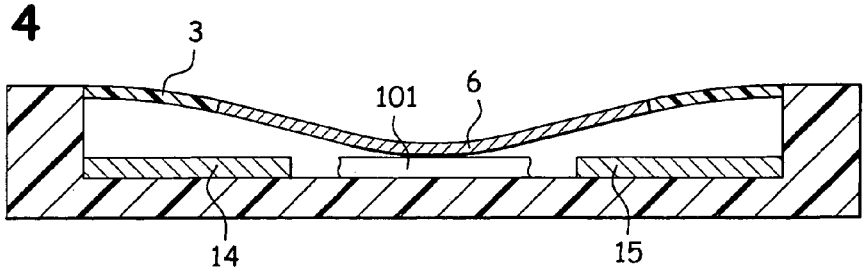
FIGS. 4 and 5 are explanatory views of the operating of the micro-switch of the invention, corresponding to FIG. 2.

FIG. 1 is a top view of an electrostatic micro-switch according to the invention.

The surface of the micro-switch is made of an insulator substrate. The surface bears a recess 1 delimited by edges 2, 12, 22 and 32 overhanging it. The beam 3 is created above the recess 1 by a first end integral with the edge 22 and a second end integral with the edge 32. Therefore it is a beam embedded at its two ends.

The beam 3 has two annex parts or fins 13 and 23 located at the same level as the beam 3. The fins 13 and 23 are located on either side of the beam 3. They are attached to the beam by a pinched-off central part. They are attached to the edges 2 and 12 by pinched-off lateral parts.

The electrically conductive paths to be connected are marked by 4 and 5. They have ends, respectively 14 and 15, placed under the beam 3 and aligned along the longitudinal axis of the beam 3, facing each other.

The bottom of the recess 1 supports two lower electrodes 101 and 102 that can respectively be electrically connected via the contact studs 111 and 112. The electrodes 101 and 102 are placed symmetrically in relation to the longitudinal axis of the beam 3. The electrode 101 lies facing a first lateral part of the beam 3 and facing the fin 13. The electrode 102 lies facing a second lateral part of the beam 3 and facing the fin 23.

The beam 3 supports several electric conductors: a contact stud 6 and two electrodes 7 and 8. The contact stud 6 is located along the longitudinal axis of the beam 3 and extends slightly above the ends 14 and 15 of the conductor paths 4 and 5. The contact stud 6 extends beyond the lower face of the beam 3 or flush along this lower face so as to electrically connect the ends 14 and 15 if the beam 3 is sufficiently distorted.

The electrodes 7 and 8 are located on the face of the beam 3 opposite the recess. Each of them is located on a lateral part of the beam so that the electrode 7 lies facing the corresponding part of the lower electrode 101 and that the electrode 8 lies facing the corresponding part of the lower electrode 102. The electrodes 7 and 8 can respectively be electrically connected by the contact studs 17 and 18.

The upper surface of the fin 13, that being the face opposite the recess, supports an electrode 33 that can be electrically connected by a contact stud 43. The electrode 33 lies facing a part of the lower electrode 101. Likewise, the upper surface of the fin 23 supports an electrode 53 that can be electrically connected by a contact stud 63. The electrode 53 lies facing a part of the lower electrode 102.

FIG. 2 is a cross section along the axis II-II in FIG. 1 and FIG. 3 is a cross section along axis III-III in FIG. 1. These figures show the non-deviated state of the beam 3 in the absence of potentials applied to the electrodes.

Figure 5:
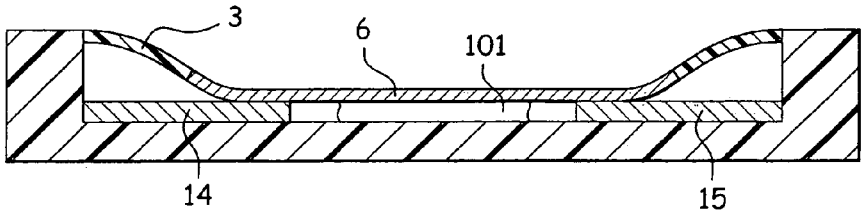

FIGS. 4 and 5 are explanatory views of the operating of the micro-switch. These views correspond to the section represented in FIG. 2.

A voltage V1 is firstly applied to the first set of electrodes constituted on one hand by the electrodes 33 and 53 and on the other hand by the electrodes 101 and 102. The voltage V1, initiating voltage of the distortion, is chosen to flatten the centre of the beam against the lower electrodes 101 and 102 as shown in FIG. 4. In the case of a cantilever beam or cantilever, this first set of electrodes would have been used to flatten the end of the beam against the lower electrodes.

The applying of voltage V1 to the first set of electrodes puts the micro-switch into operating mode but in the non-switched state, the ends 14 and 15 of the conductor paths being sufficiently distanced from each other so that mechanical contact with the beam is attained without any electrical contact. This displacement of the beam only being actuated to initiate the switch (for example upon switching on a mobile phone), the damping engendered by the large surface of these electrodes has no consequence on the commutation time of the operating interrupter.

This first set of electrodes has a sufficient surface to allow the limiting of the beam for a voltage less than 10 V, even less than 5 V.

A voltage V2 is then applied to the second set of electrodes constituted on one hand by the electrodes 7 and 8 and on the other hand by the electrodes 101 and 102. The voltage V2, switching voltage, is chosen to distort the beam 3 until the coming together of the ends 14 and 15 to be connected with the contact stud 6 of the beam, as shown in FIG. 5. The nearness of the electrodes facing the second set of electrodes, due to the bending of the beam during the initiating of the distortion, allows to actuate the micro-switch with a low voltage whilst preserving an acute stiffness of the beam.

The arrangement and the number of electrodes can be variable. The beam can be constituted of one or several electrodes.

The distortion of the beam under the effect of an initiation voltage allows to dramatically reduce the voltage for maintaining the beam in the distorted state during switching.

The invention procures a high level of stability and reliability of the operating micro-switch. This is due to the considerable mechanical stiffness of the operating micro-switch, that being after the initiating of the distortion. Thus during operating it is hardly sensitive to shocks and accelerations, as well as possible entrapment effects of loads in the dielectric layer.

The commutation time is reduced, given the slight displacement of the beam between the non-switched position and the switched position (limited displacement of air therefore limited damping).

The high frequency insulation is optimised through the considerable distancing of the two paths to be connected.

Another advantage of the invention consists in the manufacturing of micro-switches according to a technique compatible with the manufacturing technique of integrated circuits.

In terms of performance, the device of the invention is distinguished from the micro-switches of the prior art through the following characteristics. The operating voltage is low whilst preserving a slight sensitivity to accelerations, high operating reliability, short commutation time and mechanical relaxation time.

The two-step operating mode also distinguishes the device according to the invention from the micro-switches of the prior art. The distortion initiating stage is performed with a low operating voltage and without any major constraints on the response time, on the risk of electrostatic bonding and on the sensitivity to accelerations. The commutation stage is performed with a low operating voltage meeting the criteria of slight sensitivity to accelerations, of slight sensitivity to the risks of electrostatic bonding and of short commutation time.

FIGS. 6A to 6G to 6G are cross sections illustrating a method for making a micro-switch according to the invention.

Figure 6A:
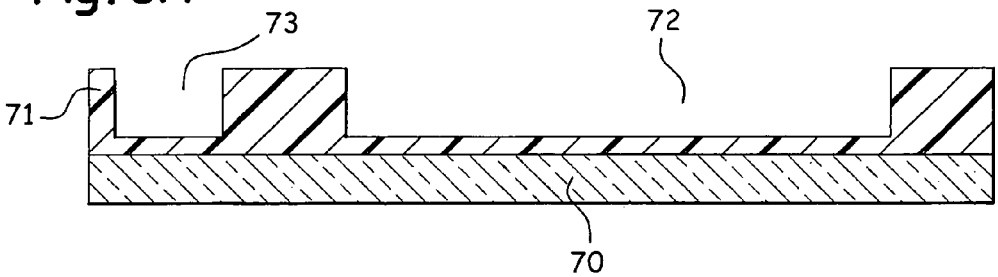
FIGS. 6A to 6G are cross sections illustrating a method for making a micro-switch according to the invention.
Figure 6B:
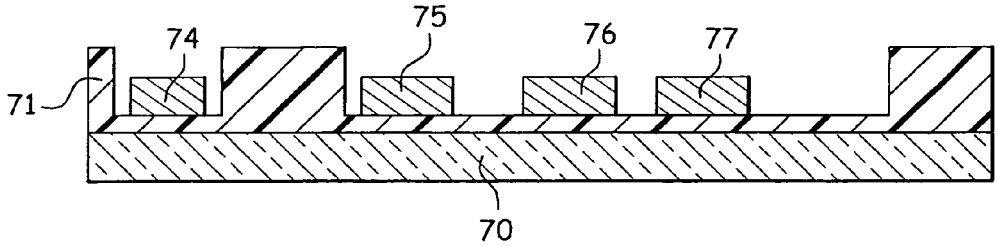

FIG. 6A shows a silicon substrate 70 covered in a deposit of silicon dioxide 71 which has undergone a lithographic operation in order to define an inlay. The dioxide deposit can have a thickness of 2 μm and an etching depth of 1.7 μm. The etching defines a recess 72 and wells for electrode contact studs and conductor paths of which one, the well 73, is visible.

A metallic deposit is then applied to the etched structure. It can be a bilayer comprising an adhesive layer made in Cr with a thickness of 0.05 μm and a layer of gold with a thickness of 0.9 μm. We then lithograph the metallic layer in the recess and in the wells of contact studs in order to define the paths to be connected and the lower initiating and switching electrodes. The unprotected metal is etched so as to obtain the structure illustrated in FIG. 6B. In this figure, the marking 74 represents the contact stud of a lower control electrode, the markings 75 and 76 represent the far ends of the conductor paths to be connected, the marking 77 represents a lower control electrode.

Figure 6C:
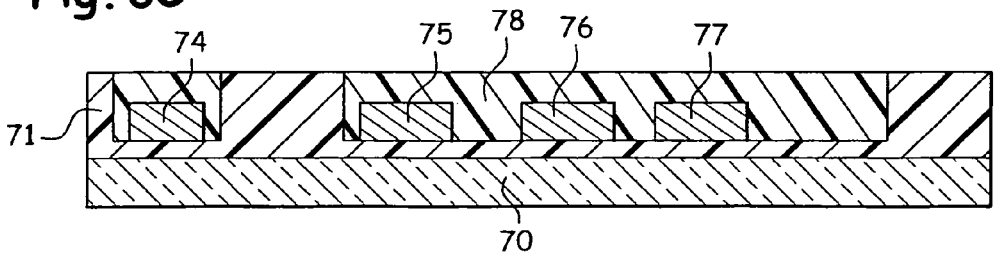

FIG. 6C shows that a sacrificial layer 78, for example made in polyimide, has been deposited on the structure and levelled out down to the tip of the dioxide layer 71.

Figure 6D:
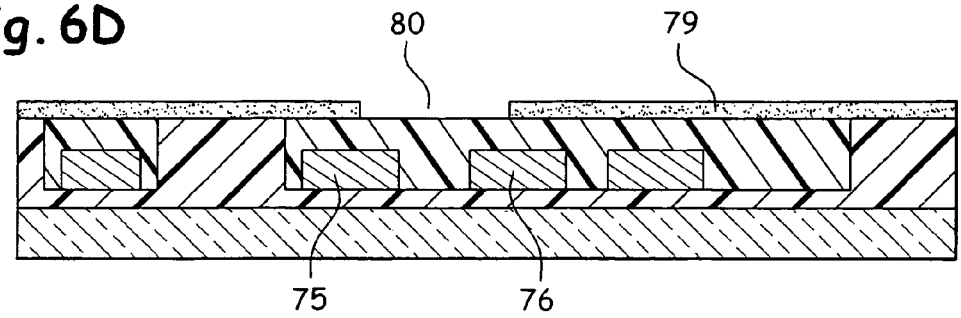

FIG. 6D shows that a layer of dielectric material 79 has been deposited on the structure in order to constitute the beam. It can be a layer of $Si_3N_4$ with a thickness of 0.5 μm. An opening 80 is made, via lithography, in the layer 79 in order to define the position for the contact stud of the micro-switch in the vicinity of the ends of the paths 75 and 76.

Figure 6E:
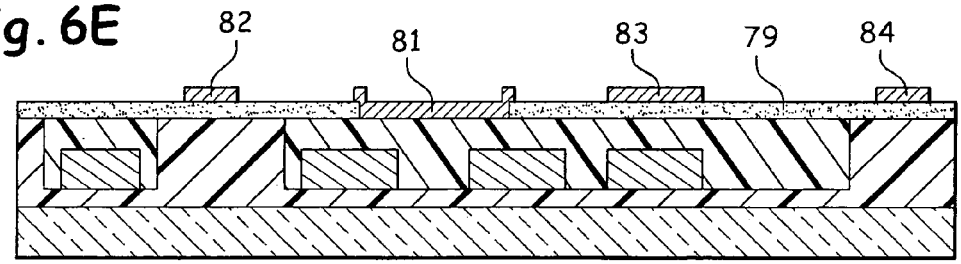

A metallic deposit is then applied to the structure. It can be a layer of gold with a thickness of 0.5 μm. This layer then undergoes lithography in order to define the contact stud of the conductor paths and the upper initiating and switching electrodes. The etching of this layer allows to obtain these conductor elements. FIG. 6E shows the contact stud 81, a contact stud 82 of the initiating electrodes (not shown), a switching electrode 83 and a contact stud 84 of a switching electrode.

Figure 6F:
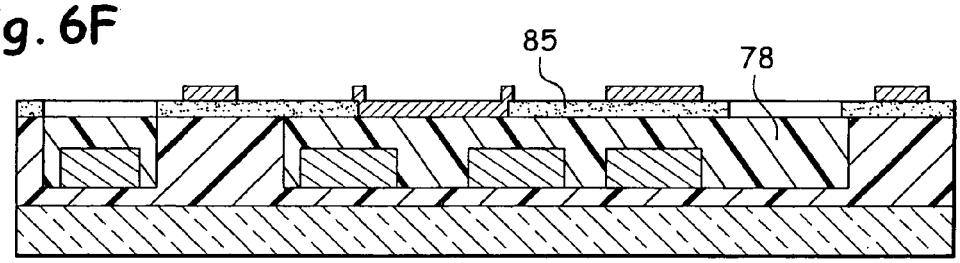
Figure 6G:
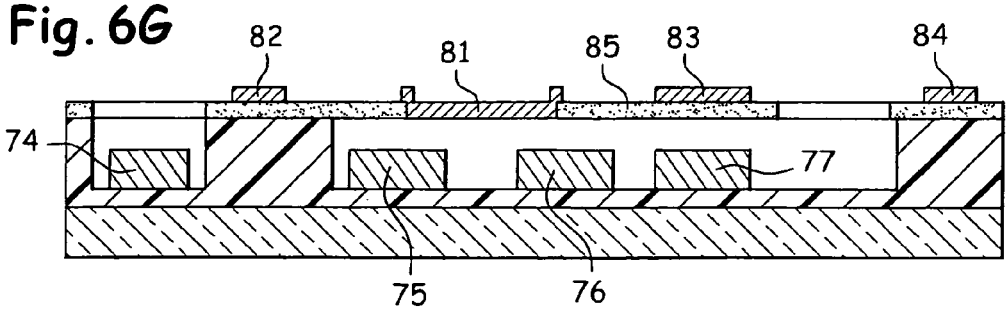

The layer 79 is then treated via lithography in order to define the beam 85 with the etching terminating on the sacrificial layer 78 (see FIG. 6F).

The sacrificial layer is then removed via dry etching, for example of oxygen plasma type. We obtain the structure represented in FIG. 6G.

The invention claimed is:

1. Electrostatic micro-switch intended to electrically connect at least two electrically conductive paths placed on a support, the electric connection between the two conductor paths being created by means of a contact stud fitted to the distortion means made in insulating material and capable of distorting in relation to the support, under the influence of an electrostatic force generated by control electrodes, the contact stud electrically connecting the ends of the two conductor paths when the distortion means are sufficiently distorted, wherein the control electrodes are laid out on the distortion means and the support in two sets of electrodes, a first set of electrodes intended to generate a first electrostatic force to initiate the distorting of the distortion means until it creates a mechanical contact with the distortion means, the ends of the conductor paths being sufficiently distanced from each other so that the contact stud does not electrically connect the ends of the conductor paths, a second set of electrodes intended to generate a second electrostatic force to continue the distorting of the distortion means so that the contact stud electrically connects the ends of the two conductor paths.

2. Electrostatic micro-switch according to claim 1, wherein the control electrodes laid out on the distortion means are placed on the latter so that the distortion means are interposed between them and the control electrodes laid out on the support.

3. Electrostatic micro-switch according to claim 1, wherein the control electrodes laid out on the support comprise two electrodes each of which is a common electrode to the first set of electrodes and to the second set of electrodes.

4. Electrostatic micro-switch according to claim 1, wherein the distortion means comprise a beam embedded at its two ends or a cantilever beam.

5. Electrostatic micro-switch according to claim 4, wherein the control electrodes laid out on the distortion means comprise the electrodes of one of the two sets of electrodes placed on the annex parts attached to the beam and fitted on each side of the beam.

6. Electrostatic micro-switch according to claim 5, wherein the control electrodes laid out on the distortion means comprise the electrodes of the other of the two sets of electrodes placed on the beam and fitted on each side of the contact stud.

* * * * *